US012043817B1

(12) United States Patent
Hurley

(10) Patent No.: US 12,043,817 B1
(45) Date of Patent: Jul. 23, 2024

(54) LOW VISCOSITY LUBRICATING FLUID FOR AN ELECTRIC MOTOR SYSTEM

(71) Applicant: Afton Chemical Corporation, Richmond, VA (US)

(72) Inventor: Susie Hurley, London (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/342,010

(22) Filed: Jun. 27, 2023

(51) Int. Cl.

| | |
|---|---|
| ***C10M 169/04*** | (2006.01) |
| ***C10M 135/36*** | (2006.01) |
| ***C10M 137/08*** | (2006.01) |
| ***C10M 137/10*** | (2006.01) |
| ***C10M 141/10*** | (2006.01) |
| ***C10M 155/00*** | (2006.01) |
| ***C10M 161/00*** | (2006.01) |
| ***C10M 177/00*** | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 30/06* | (2006.01) |
| *C10N 40/00* | (2006.01) |
| *C10N 70/00* | (2006.01) |

(52) U.S. Cl.
CPC ..... *C10M 169/044* (2013.01); *C10M 135/36* (2013.01); *C10M 137/08* (2013.01); *C10M 137/105* (2013.01); *C10M 141/10* (2013.01); *C10M 155/00* (2013.01); *C10M 161/00* (2013.01); *C10M 177/00* (2013.01); *C10M 2203/003* (2013.01); *C10M 2219/044* (2013.01); *C10M 2219/106* (2013.01); *C10M 2223/043* (2013.01); *C10M 2223/047* (2013.01); *C10M 2229/00* (2013.01); *C10N 2020/02* (2013.01); *C10N 2020/04* (2013.01); *C10N 2030/02* (2013.01); *C10N 2030/04* (2013.01); *C10N 2030/06* (2013.01); *C10N 2040/40* (2020.05); *C10N 2070/02* (2020.05)

(58) Field of Classification Search
CPC ..... C10M 169/044; C10M 135/36; C10M 137/08; C10M 137/105; C10M 141/10; C10M 155/00; C10M 161/00; C10M 177/00; C10M 2203/003; C10M 2219/044; C10M 2219/106; C10M 2223/043; C10M 2223/047; C10M 2229/00; C10N 2020/02; C10N 2020/04; C10N 2030/02; C10N 2030/04; C10N 2030/06; C10N 2040/40; C10N 2070/02
See application file for complete search history.

(56) References Cited

U.S. PATENT DOCUMENTS

| | | | | |
|---|---|---|---|---|
| 4,859,352 | A | 8/1989 | Waynick | |
| 6,586,374 | B1 | 7/2003 | Paul | |
| 6,667,281 | B2 | 12/2003 | Ikejima et al. | |
| 6,903,056 | B2 | 6/2005 | Nagano et al. | |
| 8,143,202 | B2 | 3/2012 | Peer et al. | |
| 8,400,030 | B1 | 3/2013 | Tang et al. | |
| 8,563,486 | B2 | 10/2013 | Tsujimoto et al. | |
| 8,664,169 | B2 | 3/2014 | Bouffet | |
| 8,901,052 | B2 | 12/2014 | Sagawa et al. | |
| 8,999,904 | B2 | 4/2015 | Matsui et al. | |
| 9,522,972 | B2 | 12/2016 | Visger et al. | |
| 9,574,156 | B2 | 2/2017 | Tang et al. | |
| 9,598,658 | B2 | 3/2017 | Scanlon et al. | |
| 9,896,634 | B2 | 2/2018 | Gao et al. | |
| 9,944,877 | B2 | 4/2018 | Gao et al. | |
| 11,326,123 | B1 | 5/2022 | Adhvaryu et al. | |
| 11,479,735 | B2 | 10/2022 | Iyer et al. | |
| 2002/0151441 | A1 | 10/2002 | Srinivasan | |
| 2002/0151443 | A1 | 10/2002 | Srinivasan | |
| 2007/0037715 | A1 | 2/2007 | Okada | |
| 2008/0194442 | A1 | 8/2008 | Watts et al. | |
| 2008/0302422 | A1 | 12/2008 | Neveu et al. | |
| 2010/0130390 | A1 | 5/2010 | Tipton | |
| 2012/0208731 | A1 | 8/2012 | Lann et al. | |
| 2012/0283159 | A1 | 11/2012 | Matsui et al. | |
| 2013/0225461 | A1* | 8/2013 | Barton | C10M 137/08 508/428 |
| 2014/0162919 | A1* | 6/2014 | Fu | C10M 141/08 508/281 |
| 2014/0249061 | A1 | 9/2014 | Youn et al. | |
| 2014/0296118 | A1 | 10/2014 | Costello et al. | |
| 2015/0038385 | A1* | 2/2015 | Barton | C10M 141/08 508/415 |
| 2015/0322322 | A1 | 11/2015 | Sondjaja et al. | |
| 2016/0024416 | A1 | 1/2016 | Kamano | |
| 2016/0108337 | A1 | 4/2016 | Abraham et al. | |
| 2016/0281020 | A1* | 9/2016 | Yamamoto | C10M 141/10 |
| 2017/0130161 | A1 | 5/2017 | Vettel et al. | |
| 2017/0306259 | A1 | 10/2017 | Ding et al. | |
| 2018/0072962 | A1 | 3/2018 | Wada et al. | |
| 2018/0079990 | A1 | 3/2018 | Aoyama | |
| 2018/0100114 | A1 | 4/2018 | Gao et al. | |
| 2018/0100115 | A1 | 4/2018 | Gao et al. | |
| 2018/0100117 | A1 | 4/2018 | Flores-Torres et al. | |
| 2018/0100118 | A1 | 4/2018 | Flores-Torres et al. | |
| 2018/0100119 | A1 | 4/2018 | Aoyama | |

(Continued)

FOREIGN PATENT DOCUMENTS

| | | | |
|---|---|---|---|
| FR | 3097873 | A1 | 1/2021 |
| WO | 2014186318 | A1 | 11/2014 |

(Continued)

*Primary Examiner* — Cephia D Toomer
(74) *Attorney, Agent, or Firm* — Honigman LLP

(57) ABSTRACT

An electric motor lubricating fluid for an electric motor system including a lubricating base oil, at least one sulfurized component, at least two phosphorus-providing additives, and at least one high molecular weight dispersant. The electric motor lubricating fluid provides acceptable wear performance as well as good electrical conductivity and oxidative stability for use in electric motor system fluids having a low viscosity.

27 Claims, No Drawings

(56) References Cited

U.S. PATENT DOCUMENTS

| | | | |
|---|---|---|---|
| 2018/0134983 | A1 | 5/2018 | Broutin et al. |
| 2018/0327687 | A1 | 11/2018 | Kwak |
| 2019/0002785 | A1 | 1/2019 | Sanson et al. |
| 2019/0002790 | A1 | 1/2019 | Sanson et al. |
| 2019/0078034 | A1 | 3/2019 | Saccomando et al. |
| 2019/0112541 | A1 | 4/2019 | Hamachi |
| 2019/0367830 | A1 | 12/2019 | Iwai |
| 2020/0248095 | A1 | 8/2020 | Guerin |
| 2020/0277542 | A1 | 9/2020 | Salvi et al. |
| 2021/0009920 | A1 | 1/2021 | Kwak |

FOREIGN PATENT DOCUMENTS

| | | | |
|---|---|---|---|
| WO | 2017189277 | A1 | 11/2017 |
| WO | 2017210388 | A1 | 12/2017 |

* cited by examiner

LOW VISCOSITY LUBRICATING FLUID FOR AN ELECTRIC MOTOR SYSTEM

TECHNICAL FIELD

The present disclosure relates to a lubricating fluid for an electric motor system and a method of lubricating gears and clutches in the electric motor system. In particular, the disclosed methods and lubricating fluid relate to a low viscosity lubricating fluid for use in an electric motor of an electric or hybrid-electric vehicle including an oil of lubricating viscosity and at least one higher molecular weight dispersant.

BACKGROUND

A major challenge in developing electric vehicle powertrain lubricants is achieving acceptable wear and friction performance as well as maintaining oxidative stability, while ensuring lubricant compatibility with the electrified components in the powertrain. Because lubricants in electric or hybrid-electric vehicles may also contact components in the electric motor, the fluid's electrical conductivity also needs to be relatively low to inhibit electrostatic buildup and discharge of the electrified components.

To improve efficiency, lubricant manufacturers often seek to lower lubricant viscosity, but lower viscosity fluids are often less desirable for the demanding wear and friction tests often required by industry and/or automotive manufacturers. As such, low viscosity fluids may often require additional antiwear additives to meet the required wear tests. However, adding these additional additives often increases the electrical conductivity and decreases the oxidative stability of the lubricant. For instance, lubricants with a kV100° C. (ASTM D445) of about 4.5 cSt or lower may require higher amounts of antiwear additives than would be required in higher viscosity lubricants to achieve the required wear performance, but the addition of certain antiwear additives can result in increased conductivity and decreased oxidative stability. In particular, it has previously been challenging for low viscosity lubricants having a kV100° C. of about 4.5 cSt or less, or 3.5 cSt or less, or 3.0 cSt or less to pass severe FZG wear tests, such as the demanding A10/16.6R/90 scuffing test of CEC L-84-02, while also exhibiting low conductivity and maintaining oxidative stability.

SUMMARY

In one embodiment, an electric motor lubricating fluid suitable for electric or hybrid-electric vehicles is described herein. In approaches, the electric motor lubricating fluid includes one or more base oils of lubricating viscosity; a succinimide dispersant derived from a polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant delivers about 70 to about 140 ppm phosphorus and about 150 to about 300 ppm nitrogen to the electric motor lubricating fluid; an amine salt of a phosphoric acid ester providing about 40 to about 70 ppm of phosphorus to the electric motor lubricating fluid; an oil-soluble phosphorus antiwear additive including an ashless dialkyl dithiophosphate providing about 40 to about 70 ppm of phosphorus to the electric motor lubricating fluid; a sulfur-providing additive including a thiadiazole or derivative thereof providing up to about 950 ppm of sulfur to the electric motor lubricating fluid; and wherein the electric motor lubricating fluid has a kV100° C. of about 4.5 cSt or less and about 150 to about 250 ppm of total phosphorus.

In other approaches or embodiments, the electric motor lubricating of the previous paragraph may include one or more optional features or embodiments in any combination. These optional features or embodiments may include one or more of the following: wherein the amine salt of a phosphoric acid ester has the structure of Formula I or a solvate or hydrate thereof:

(Formula I)

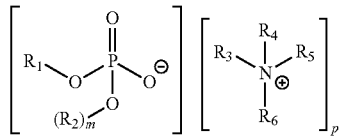

wherein $R_1$ and $R_2$ are, independently, hydrogen or a linear, branched, or cyclic hydrocarbyl group; m is an integer from 0 to 1, p is an integer from 1 to 2, and m+p equals 2; $R_3$, $R_4$, $R_5$, and $R_6$ are, independently, hydrogen or a hydrocarbyl group and at least one of $R_3$ to $R_6$ is a hydrocarbyl group; and/or wherein $R_1$ and $R_2$ are, independently, a $C_3$ to $C_{10}$ alkyl group and wherein at least one of $R_3$, $R_4$, $R_5$ and $R_6$ is a $C_{10}$ to $C_{20}$ alkyl group; and/or wherein the number average molecular weight of the high molecular weight polyisobutylene is about 2,000 to about 2,300; and/or wherein the electric motor lubricating fluid includes about 2 to about 4 weight percent of the succinimide dispersant; and/or wherein the succinimide dispersant, the amine salt of a phosphoric acid ester, the ashless dialkyl dithiophosphate, and the thiadiazole or derivative thereof are provided in an additive concentrate and wherein the additive concentrate has a kV100° C. of about 15 to about 80 cSt; and/or wherein a ratio of the kV100° C. of the additive concentrate to the kV100° C. of the electric motor lubricating fluid is about 5:1 to about 30:1: and/or wherein the electric motor lubricating fluid has a change in viscosity of less than 0.09 cSt after the electric motor lubricating fluid has been aged according to CEC L-48-A); and/or wherein the electric motor lubricating fluid achieves a failure load stage of at least 8 in the FZG A10/16.6R/90 scuffing test of CEC L-84-02; and/or wherein the electric motor lubricating fluid has an electrical conductivity of about 60 nS/M or less as measured by a modified conductivity test pursuant to ASTM D2624-15 using the electric motor lubricating fluid and measured at 20 Hz and at 100° C.; and/or wherein the oil-soluble phosphorus antiwear additive including the ashless dialkyl dithiophosphate is made by a process comprising the steps of (a) reacting an organic hydroxy compound with phosphorus pentasulfide to form a reaction product and further reacting the reaction product with an unsaturated carboxylic acid to form the oil-soluble phosphorus antiwear additive including the ashless diaalkyl dithiophosphate; and/or wherein the ashless dialkyl dithiophosphate includes a compound of Formula II, or a salt thereof:

(Formula II)

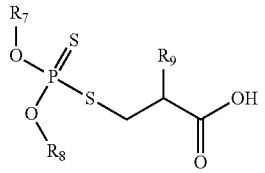

wherein $R_7$ and $R_8$ are, independently, a $C_3$ to $C_8$ linear or branched alkyl group, and $R_9$ is —H or —$CH_3$; and/or wherein the ashless dialkyl dithiophosphoate is 3-[[bis(2-methylpropoxy) phosphinothioyl]thio]-2-methyl-propanoic acid; and/or wherein the thiadiazole or derivative thereof includes one or more compounds having a structure of Formula III:

(Formula III)

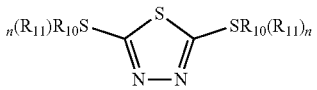

wherein each $R_{10}$ is, independently, hydrogen or sulfur; each $R_{11}$ is, independently, an alkyl group; n is an integer of 0 or 1 and if $R_{10}$ is hydrogen then the integer n of the adjacent $R_{11}$ moiety is 0 and if $R_{10}$ is sulfur then the n of the adjacent Rn moiety is 1; and wherein at least one $R_{10}$ is sulfur; and/or further including one or more metal-containing detergent additives providing no more than about 50 ppm of calcium to the electric motor lubricating fluid.

In yet other embodiments, the present disclosure provides for an additive concentrate suitable for an electric motor lubricating fluid. In approaches, the additive concentrate includes a succinimide dispersant derived from a high molecular weight polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant is present in an amount to deliver about 1400 to about 2450 ppm phosphorus and about 3000 to about 5400 ppm nitrogen to the dispersant additive concentrate; an amine salt of a phosphoric acid ester providing about 1000 to about 1500 ppm of phosphorus to the additive concentrate; an oil-soluble phosphorus antiwear additive including an ashless dialkyl dithiophosphate providing about 800 ppm to about 1300 ppm of phosphorus to the additive concentrate; a sulfur-providing additive including a thiadiazole or derivative thereof providing sulfur, but no more than about 18,000 ppm of sulfur to the additive concentrate; and wherein the additive concentrate has a kV100° C. of about 15 cSt to about 80 sCt.

In other embodiments, the additive concentrate of the previous paragraph may include one or more optional features or embodiments in any combination. These optional feature or embodiments may include one or more of the following: wherein the amine salt of a phosphoric acid ester has the structure of Formula I or a solvate or hydrate thereof:

(Formula I)

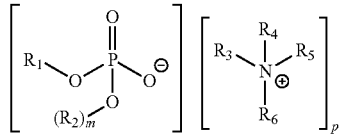

wherein $R_1$ and $R_2$ are, independently, hydrogen or a linear, branched, or cyclic hydrocarbyl group; m is an integer from 0 to 1, p is an integer from 1 to 2, and m+p equals 2, $R_3$, $R_4$, $R_5$, and $R_6$ are, independently, hydrogen or a hydrocarbyl group and at least one of $R_3$ to $R_6$ is a hydrocarbyl group; and/or wherein $R_1$ and $R_2$ are, independently, a C3 to C10 alkyl group and wherein at least one of $R_3$, $R_4$, $R_5$, and $R_6$ is a $C_{10}$ to $C_{20}$ alkyl group; and/or wherein the number average molecular weight of the high molecular weight polyisobutylene is about 2,000 to about 2,300; and/or wherein the succinimide dispersant comprises about 40 to about 70 weight percent of the additive concentrate; and/or wherein the oil-soluble phosphorus antiwear additive including the ashless dialkyl dithiophosphate is made by a process comprising the steps of (a) reacting an organic hydroxy compound with phosphorus pentasulfide to form a reaction product and further reacting the reaction product with an unsaturated carboxylic acid to form the oil-soluble phosphorus antiwear additive including the ashless dialkyl dithiophosphate; and/or wherein the ashless dialkyl dithiophosphate includes a compound of Formula II, or a salt thereof:

(Formula II)

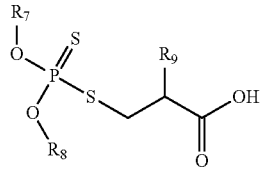

wherein $R_7$ and $R_8$ are, independently, a $C_3$ to $C_8$ linear or branched alkyl group, and $R_9$ is —H or —$CH_3$; and/or wherein the ashless dialkyl dithiophosphoate is 3-[[bis(2-methylpropoxy) phosphinothioyl]thio]-2-methyl-propanoic acid; and/or wherein the thiadiazole or derivative thereof includes one or more compounds having a structure of Formula III:

(Formula III)

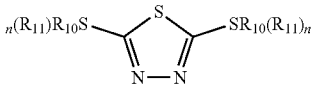

wherein each $R_{10}$ is, independently, hydrogen or sulfur; each $R_{11}$ is, independently, an alkyl group; n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur: and/or further including one or more metal-containing detergent additives providing no more than about 950 ppm of calcium to the additive concentrate.

In yet other embodiments, a method for lubricating a driveline component including an electric motor is also described herein. In approaches, the method includes lubricating the driveline component with an electric motor lubricating composition and wherein the electric motor lubricating composition contacts portions of the electric motor; and wherein the electric motor lubricating composition includes (i) one or more base oils of lubricating viscosity; (ii) a succinimide dispersant derived from a high molecular weight polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant delivers about 70 to about 140 ppm phosphorus and about 150 to about 300 ppm nitrogen to the electric motor lubricating fluid; (iii) an amine salt of a phosphoric acid ester providing about 40 to about 70 ppm of phosphorus to the electric motor lubricating fluid; (iv) an oil-soluble phosphorus antiwear additive including an ashless dialkyl dithiophosphate providing about 40 to about 70 ppm of phosphorus to the electric motor lubricating fluid; and (v) a sulfur-providing additive including a thiadiazole or derivative thereof providing sulfur, but no more than about 950 ppm of sulfur to the electric motor lubricating fluid; and wherein the electric motor lubricating fluid has a kV100° C. of about 4.5 cSt or less, about 150 to about 250 ppm of total phosphorus, and an electrical conductivity of about 37 nS/M or less, as measured by a modified conductivity test pursuant to ASTM D2624-15 using the electric motor lubricating fluid and measured at 20 Hz and at 100° C.

In yet further embodiments, the method for lubricating a driveline component including an electric motor of the previous paragraph may further include one or more optional method steps, features, or embodiments in any combination. These optional method steps, features, or embodiments may include one or more of the following: wherein the amine salt of a phosphoric acid ester has the structure of Formula I or a solvate or hydrate thereof:

(Formula I)

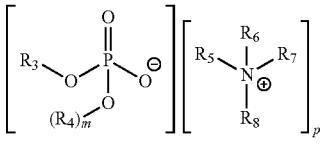

wherein $R_1$ and $R_2$ are, independently, hydrogen or a linear, branched, or cyclic hydrocarbyl group; m is an integer from 0 to 1, p is an integer from 1 to 2, and m+p equals 2, $R_3$, $R_4$, $R_5$, and $R_6$ are, independently, hydrogen or a hydrocarbyl group and at least one of $R_3$ to $R_6$ is a hydrocarbyl group; and/or wherein $R_1$ and $R_2$ are, independently, a $C_3$ to $C_{10}$ alkyl group and wherein at least one of $R_3$, $R_4$, $R_5$, and $R_6$ is a $C_{10}$ to $C_{20}$ alkyl group; and/or wherein the number average molecular weight of the high molecular weight polyisobutylene is about 2,000 to about 2,300; and/or wherein the electric motor lubricating fluid includes about 2 to about 4 weight percent of the succinimide dispersant; and/or wherein the succinimide dispersant, the amine salt of a phosphoric acid ester; the oil-soluble phosphorus antiwear additive including an ashless dialkyl dithiophosphate; and the sulfur-providing additive including a thiadiazole or derivative thereof are provided in an additive concentrate having a kV100° C. of about 15 to about 80 cSt; and/or wherein a ratio of the kV100° C. of the additive concentrate to the kV100° C. of the electric motor lubricating fluid is about 5:1 to about 30:1; and/or wherein the electric motor lubricating fluid has a change in viscosity of less than 0.09 cSt after the electric motor lubricating fluid has been aged according to CEC L-48-A; and/or wherein the electric motor lubricating fluid achieves a failure load stage of at least 8 in the FZG A10/16.6R/90 scuffing test of CEC L-84-02; and/or wherein the oil-soluble phosphorus antiwear additive including the ashless dialkyl dithiophosphate is made by a process comprising the steps of (a) reacting an organic hydroxy compound with phosphorus pentasulfide to form a reaction product and further reacting the reaction product with an unsaturated carboxylic acid to form the oil-soluble phosphorus antiwear additive including the ashless diaalkyl dithiophosphate; and/or wherein the ashless dialkyl dithiophosphate includes a compound of Formula II, or a salt thereof:

(Formula II)

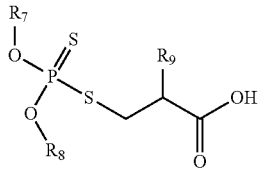

wherein $R_7$ and $R_8$ are, independently, a C3 to C8 linear or branched alkyl group, and $R_9$ is —H or —$CH_3$; and/or wherein the ashless dialkyl dithiophosphoate is 3-[[bis(2-methylpropoxy) phosphinothioyl]thio]-2-methyl-propanoic acid: and/or wherein the thiadiazole or derivative thereof includes one or more compounds having a structure of Formula III:

(Formula III)

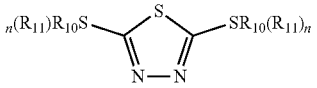

wherein each $R_{10}$ is, independently, hydrogen or sulfur; each $R_{11}$ is, independently, an alkyl group; n is an integer of 0 or 1 and if $R_{10}$ is hydrogen then the integer n of the adjacent $R_{11}$ moiety is 0 and if $R_{10}$ is sulfur then the n of the adjacent Rn moiety is 1; and wherein at least one $R_{10}$ is sulfur; and/or wherein the electric motor lubricating composition further includes one or more metal-containing detergent additives providing no more than about 50 ppm of calcium to the electric motor lubricating composition.

In yet further embodiments, the present disclosure provides for the use of an additive concentrate in an electric motor lubricating composition and/or the use of an electric motor lubricating composition to achieve a kV100° C. of about 4.5 cSt or less of the electric motor lubricating composition with about 150 to about 250 ppm of total phosphorus and having an electrical conductivity of about 37 nS/M or less, as measured by a modified conductivity test pursuant to ASTM D2624-15 using the electric motor lubricating fluid and measured at 20 Hz and at 100° C. In other embodiments, the use includes an electric motor lubricating composition having (i) one or more base oils of lubricating viscosity; (ii) a succinimide dispersant derived from a high molecular weight polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant delivers about 70 to about 140 ppm phosphorus and about 150 to about 300 ppm nitrogen to the electric motor lubricating fluid; (iii) an amine salt of a phosphoric acid ester providing about 40 to about 70 ppm of phosphorus to the electric motor lubricating fluid; (iv) an oil-soluble phosphorus antiwear additive including an ashless dialkyl dithiophosphate providing about 40 to about 70 ppm of phosphorus to the electric motor lubricating fluid; and (v) a sulfur-providing additive including a thiadiazole or derivative thereof providing sulfur, but no more than about 950 ppm of sulfur to the electric motor lubricating fluid. In yet other approaches or embodiments, the use may also include any other embodiment of the electric motor lubricating composition, any other embodiment of the methods, or any other embodiment of the additive concentrates as described above in this Summary.

Other embodiments of the present disclosure will be apparent to those skilled in the art from consideration of the specification and practice of the invention disclosed herein.

The following definitions of terms are provided in order to clarify the meanings of certain terms as used herein.

The terms "lubricating oil," "lubricant composition," "lubricating composition," "lubricant" and "lubricating and cooling fluid" refer to a finished lubrication product comprising a major amount of a base oil plus a minor amount of an additive composition.

As used herein, the terms "additive package," "additive concentrate," and "additive composition," refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms.

The term "alkenyl" as employed herein refers to straight, branched, cyclic, and/or substituted unsaturated chain moieties from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "average number molecular weight" or "Mn" is determined by gel permeation chromatography (GPC) using commercially available polystyrene standards (with a Mn of about 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

According to exemplary embodiments, an electric motor lubricating fluid suitable for electric or hybrid-electric vehicles is described herein having a low viscosity at kV100° C. of about 4.5 cSt or less, about 3.5 cSt or less, or about 3.0 cSt or less and still capable of passing demanding FZG scuffing tests, such as the A10/16.6R/90 test of CEC L-84-02 and, at the same time, achieving good electrical conductivity and maintaining oxidative stability. What is surprising about the lubricating fluids herein, however, is that the combination of certain additives, including a succinimide dispersant derived from relatively high molecular weight polyisobutylene, were found helpful to achieve the passing wear, conductivity, and oxidation performance. The selected relatively high molecular weight dispersants described herein, when incorporated into an additive concentrate, result in the additive concentrate with a relatively high viscosity. Such high viscosity additive concentrates have not previously been used in low viscosity finished lubricants (such as finished lubricants with a kV100° C. of about 4.5 cSt or less, about 3.5 cSt or less, or about 3.0 cSt or less) requiring rigorous wear protection, low conductivity, and oxidative stability.

It was not expected that the relatively high viscosity additive concentrates, having the relatively high molecular weight succinimide dispersants, would have been suitable to form a low viscosity finished lubricant capable of passing the wear, conductivity, and oxidation performance testing for electric and/or hybrid-electric vehicles. But, when the selected relatively high molecular weight succinimide dispersants herein were combined with other lubricant additives having to certain elemental relationships, to form the finished lubricants, the finished lubricants herein achieved a low viscosity, passing scuffing performance, suitable conductivity, and oxidative stability for drivelines having electric or hybrid-electric motors.

It was discovered herein that relatively high-molecular weight polyisobutylene dispersants can be provided to a fluid for such electric or hybrid-electric applications having low finished fluid viscosity if such high molecular weight dispersants are also provided in combination with select amounts of phosphorus, nitrogen, and/or sulfur from other additives including, for instance, an amine salt of a phosphoric acid ester, an ashless dialkyl dithiophosphate, and a thiadiazole or derivative thereof in the finished fluid in certain amounts. In one approach, for instance, the fluids herein include (i) a succinimide dispersant derived from polyisobutylene having a number average molecular weight of about 2,000 or greater and having up to about 1 weight percent nitrogen, post treated with a phosphorus containing compound and a boron containing compound, and wherein the succinimide dispersant delivers about 60 to about 120 ppm phosphorus and about 150 to about 300 ppm nitrogen to the electric motor lubricating fluid; (ii) an amine salt of a phosphoric acid ester providing about 45 to about 75 ppm of phosphorus to the electric motor lubricating fluid; (iii) an oil-soluble phosphorus antiwear additive including an ashless dialkyl dithiophosphate providing about 40 to about 70 ppm of phosphorus to the electric motor lubricating fluid; (iv) a sulfur-providing additive including a thiadiazole or derivative thereof providing sulfur to the lubricant, but no more than about 950 ppm of sulfur to the electric motor lubricating fluid; and wherein the electric motor lubricating fluid has a kV100° C. of about 4.5 cSt or less, about 3.5 cSt or less, or about 3.0 cSt or less (ASTM D4450), about 150 to about 250 ppm of total phosphorus, and an electrical conductivity of about 60 nS/M or less as measured by a modified conductivity test pursuant to ASTM D2624-15 using the electric motor lubricating fluid and measured at about 20 Hz and at about 100° C. In yet other embodiments, the lubricants herein may also include certain amounts of calcium from detergent additives (such as up to about 50 ppm of calcium in lubricants or up to about 950 ppm of calcium in additive concentrates from neutral to low-based detergents). Each of the component additives is further described below.

Succinimide Dispersant:

The electric motor lubricating fluids herein contain a dispersant system with at least one oil-soluble ashless dispersant that is a succinimide dispersant derived from a relatively high molecular weight polyisobutylene having a number average molecular weight of about 2,000 or greater and that is also post treated with a phosphorus-containing compound and a boron-containing compound. Such relatively high-molecular weight succinimide dispersant, at appropriate treat rates, results in a dispersant additive concentrate having a kV100° C. of about 15 to about 80 cSt (ASTM D445). Succinimide dispersants herein can be derived from relatively high-molecular weight hydrocarbyl-substituted dicarboxylic acids or anhydrides reacted with polyalkylene polyamines. Succinimide dispersants and their preparation are disclosed in at least U.S. Pat. No. 7,897,696 and/or 4,234,435, which are incorporated herein by reference.

The relatively high molecular weight hydrocarbyl moiety of the hydrocarbyl-dicarboxylic acid or anhydride of may be derived from butene polymers, for example, polymers of isobutylene. Suitable polyisobutylenes for use herein include those formed from conventional polyisobutylene or highly reactive polyisobutylene having at least 60%, such as 70% to 90% and above, terminal vinylidene content. Suitable polyisobutylenes may include those prepared using $BF_3$ catalysts.

The dispersants herein have a relatively high molecular weight, and as such, the number average molecular weight of the polyisobutylene substituent of the dispersants herein may vary from at least about 2,000 and, in some instances, up to about 3,000, as determined by gel permeation chromatography (GPC) using polystyrene (with a number average molecular weight of 180 to about 18,000) as the calibration reference. The GPC method additionally provides average weight molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

The polyisobutylene moiety in the dispersants herein may also have a molecular weight distribution (MWD), also referred to as polydispersity index, as determined by the ratio of weight average molecular weight (Mw) to number average molecular weight (Mn). In some approaches or embodiments, suitable polyisobutylene moieties may have a Mw/Mn of less than about 3.0, or less than about 2.8, or less than about 2.5, and in other approaches, suitable polyisobutylene substituents have a polydispersity of from about 1.5 to about 3.0, or from about 2.0 to about 3.0.

The dicarboxylic acid or anhydride suitable to form the dispersants herein may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. In some approaches, a mole ratio of dicarboxylic acid or anhydride to hydrocarbyl moiety in a reaction mixture used to make the hydrocarbyl-dicarboxylic acid or anhydride may vary widely. Accordingly, the charge mole ratio may vary from 5:1 to 1:5, for example from 3:1 to 1:3. In some embodiments, a particularly suitable molar ratio of acid or anhydride to hydrocarbyl moiety is from 1:1 to less than 1.6:1. In other embodiments, another useful charge molar ratio of dicarboxylic acid or anhydride to hydrocarbyl moiety may be 1:1 to 1.5:1, or 1:1 to 1.4:1, or 1.1:1 to 1.3:1, or 1:1 to 1.2:1.

Any of numerous polyalkylene polyamines can be used as in preparing the dispersant additives herein. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. In some embodiments, the charge molar ratio of hydrocarbyl-dicarboxylic acid or anhydrides to polyalkylene polyamines may be from about 1:1 to about 3.0:1. In one embodiment, the dispersants in the present disclosure described herein may be the reaction product of a polyisobutenyl succinic anhydride (PIBSA), and a polyamine, for example heavy polyamines wherein the charge molar ratio of the polyisobutenyl-substituted succinic anhydride to the polyamine of about 1.7:1 to about 2.5:1.

As noted above, the high-molecular weight succinimide dispersants herein may be post treated with a boron compound. Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

The high-molecular weight succinimide dispersants herein may also be post treated with a phosphorus compound. Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to 100 carbon atoms, preferably up to 50 carbon atoms, more preferably up to 24 carbon atoms, and most preferably up to 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (mono halophosphines and dihalophosphines).

In one embodiment, the relatively high molecular weight succinimide dispersants of the fluids herein includes at least a polyisobutenyl moiety having a number average molecular weight of at least about 2000, and in other approaches, about 2000 to about 3000, or in yet further approaches, about 2000 to about 2300, and has about 0.5 to about 1 wt % of nitogen, about 0.05 to about 0.25 wt % boron, and about 0.20 to about 0.45 wt % phosphorus, or in yet further embodiments, includes at least a polyisobutenyl moiety having a number average molecular weight of between 2000 and 2300 and has about 0.60 to about 0.90 wt % nitrogen, about 0.10 to about 0.20 wt % boron, and about 0.25 to about 0.40 wt % phosphorus.

In some embodiments, the relatively high molecular weight dispersant described herein may comprise about 40 to about 70 weight percent of an additive concentrate. In some embodiments, the relatively high molecular weight succinimide dispersant described herein includes at least a polyisobutenyl moiety having a number average molecular weight of about 2000 to about 2300 and has about 0.6 to about 0.9 wt % nitrogen, about 0.10 to about 0.20 wt % boron, and about 0.25 about 0.40 wt % phosphorus and may comprises about 40 to about 70% of an additive concentrate. In some embodiments, the relatively high molecular weight succinimide dispersant described herein includes at least a polyisobutenyl moiety having a number average molecular weight of about 2000 to about 2300 and delivers about 3000 to about 5400 ppm nitrogen, about 600 to about 1000 ppm boron, and about 1400 to about 2450 ppm phosphorus to the additive concentrate.

In some embodiments, the relatively high molecular weight dispersant described herein comprises about 2.0 to about 4.0% of an electric motor lubricating fluid and delivers about 150 to about 300 ppm nitrogen, about 70 to about 140 ppm of phosphorus, and about 30 to about 60 ppm of boron. As shown in the Examples below, when such succinimide dispersants are combined with the other fluid components, and in particular, select amounts of sulfur, boron, nitrogen, and/or phosphorus, the lubricants achieve passing wear and conductivity performance, and oxidative stability.

Amine Salt of a Phosphoric Acid Ester:

The electric motor lubricating fluids herein also include a first phosphorus-providing additive in an amount to provide about 40 to about 70 ppm of phosphorus to the fluid from an amine salt. In approaches or embodiments, the first phosphorus-providing additive is in the form of an amine salt of a phosphoric acid ester. In some approaches, the amine salt of a phosphoric acid ester may include one or more monoalkyl phosphoric acid esters, dialkyl phosphoric acid esters, and/or mixtures thereof wherein the alkyl groups thereof may be linear, branched, or cyclic. The fluids herein may also include other compounds providing phosphorus, but in some embodiments, the amine salt of a phosphoric acid ester herein provides about 20 to about 40 weight % of the total phosphorus in the electric motor lubricating fluids.

In approaches or embodiments, an exemplary amine salt of a phosphoric acid ester may be represented by Formula I (Formula I)

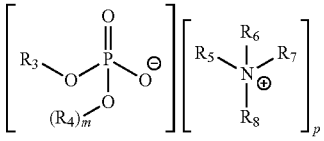

wherein $R_3$ and $R_4$ of Formula I may be independently hydrogen or a linear, branched, or cyclic hydrocarbyl group; m of Formula I is an integer from 0 to 1, p of Formula I is an integer from 1 to 2, and m+p equals 2; $R_5$, $R_6$, $R_7$ and $R_8$ of Formula I may be independently hydrogen or a hydrocarbyl group and at least one of $R_5$ to $R_8$ of Formula I is a hydrocarbyl group. Examples of a suitable alkyl or hydrocarbyl group for $R_3$ and/or $R_4$ of Formula I include straight-chain or branched alkyl groups such as, but not limited to, propyl, butyl, pentyl, hexyl, heptyl, octyl, nonyl, and/or decyl groups. In yet further exemplary approaches, $R_3$ and $R_4$ of Formula I may be a cyclic hydrocarbyl group and examples include cyclopentyl, cyclohexyl, cycloheptyl, methylcyclopentyl, dimethyl cyclopentyl, methylcyclopentyl, dimethyl cyclopentyl, methylethylcyclopentyl, diethyl-cyclo-pentyl, methylcyclohexyl, dimethylcyclohexyl, methylethylcyclohexyl, diethylcyclohexyl, methylcycloheptyl, dimethylcycloheptyl, methylethyl-cycloheptyl, and/or diethylcycloheptyl. In some approaches or embodiments, suitable amine salts of a phosphoric acid ester is a mixture of monoalkyl and dialkyl phosphoric acid esters. The monoalkyl and dialkyl groups may be linear, branched, or cyclic as noted above.

The amine salt of a phosphoric acid ester may be derived from a primary, secondary, or tertiary amine, or mixtures thereof. Exemplary amines suitable for the salt may be aliphatic, cyclic, aromatic or non-aromatic, but commonly is an aliphatic amine. Examples of suitable primary amines include ethylamine, propylamine, butylamine, 2-ethylhexylamine, bis-(2-ethylhexyl)amine, octylamine, and dodecylamine, and fatty amines such as n-octylamine, n-decylamine, n-dodecylamine, n-tetradecylamine, n-hexadecylamine, n-octadecylamine or oleyamine. Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclo-hexane, and/or ethylamylamine. The secondary amines may also be cyclic amines such as piperidine, piperazine and morpholine. Examples of suitable tertiary amines may include tri-n-butylamine, tri-n-octylamine, tri-decylamine, tri-laurylamine, tri-hexadecylamine, and/or dimethyl-oleylamine.

In some approaches, the amine of Formula I above may have at least one of the $R_5$, $R_6$, $R_7$ or $R_8$ groups being a $C_{10}$ to $C_{20}$ alkyl group, and in other approaches or embodiments, at least two of the $R_5$, $R_6$, $R_7$ or $R_8$ groups of Formula I are independently a $C_{10}$ to $C_{20}$ alkyl group. In some embodiments, at least two of the $R_5$, $R_6$, $R_7$ or $R_8$ groups of Formula I are independently a $C_{12}$ to $C_{14}$ alkyl group.

The amine salt of a phosphoric acid ester may be prepared by reacting suitable phosphorus compounds with an amine to form the amine salt of a phosphoric acid ester. In one embodiment, the amine salt of a phosphoric acid ester may be of Formula I wherein $R_3$ and $R_4$ may be independently $C_6$ or hydrogen; m is an integer from 0 to 1, p is an integer from 1 to 2, and m+p equals 2; $R_5$, $R_6$, $R_7$ and $R_8$ may be independently hydrogen or a hydrocarbyl group of $C_{12}$-$C_{14}$ and at least one of $R_5$ to $R_8$ is a hydrocarbyl group of $C_{12}$-$C_{14}$.

In embodiments, the amine salt of a phosphoric acid ester may be present in an additive concentrate in amounts of at 2 weight percent to about 3 weight percent or about 2.2 to about 2.5 weight percent. The amine salt of the phosphoric acid ester may deliver about 1000 to about 1500 ppm phosphorus or about 1000 to about 1250 ppm phosphorus to the additive concentrate.

In approaches, the amine salt of a phosphoric acid ester may be present in the electric motor lubricating fluids herein in amounts of at least about 0.1 weight percent to about 0.3 weight percent, or about 0.1 to about 0.25 weight percent of the lubricating composition. The amine salt of a phosphoric acid ester may deliver about 50 to about 150 ppm phosphorus or about 50 to about 125 ppm phosphorus to the lubricating composition.

Ashless Dialkyl Dithiophosphate:

In approaches or embodiments, the electric motor lubricating fluids herein may also include a second phosphorus-providing additive in the form of an acidic thiophosphate or a thiophosphate ester. In one approach or embodiment, this second phosphorus-providing additive may be an ashless, amine free dialkyl dithiophosphate acid ester or sulfur-containing phosphoric acid ester.

The acidic thiophosphate, the thiophosphate ester, or the sulfur-containing phosphoric acid esters of the second phosphorus compound may have one or more sulfur to phosphorus bonds. In an embodiment, the sulfur-containing phosphorus acid ester may be an acidic thiophosphate, a thiophosphate ester, a thiophosphorus acid or salt thereof. The thiophosphorus acid esters may be dithiophosphorus acid esters. In some more specific approaches, the acidic thiophosphate or thiophosphate ester may have a structure of Formula II or a salt thereof (Formula II)

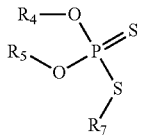

wherein $R_4$ and $R_5$ of Formula II are each, independently, a linear or branched $C_1$ to $C_{10}$ hydrocarbyl group and $R_7$ of Formula II is a $C_1$ to $C_{10}$ linear or branched carboxylic group or a $C_1$ to $C_{10}$ linear or branched alkyl alkanoate group. Preferably, $R_4$ and $R_5$ of Formula II are each a $C_3$ to $C_8$ linear or branched alkyl group and $R_7$ of Formula II is derived from 2-methyl proponoic acid such that the phosphorus product (or a salt thereof) has the structure of Formula II below:

(Formula II)

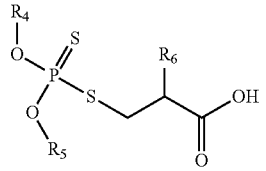

wherein $R_4$ and $R_5$ of Formula II above are, independently, a $C_3$ to $C_8$ linear or branched alkyl group (preferably, a branched $C_4$ group), and $R_6$ of Formula II above is —H or —$CH_3$. In some approaches or embodiments, the second phosphorus product is preferably 3-[[bis(2-methylpropoxy) phosphinothioyl]thio]-2-methyl-propanoic acid.

In some approaches, the oil-soluble phosphorus antiwear additive including the ashless dialkyl dithiophosphate is made by a process comprising the steps of (a) reacting an organic hydroxy compound with phosphorus pentasulfide (in some forms, a monomer or a dimer thereof) to form a reaction product and further reacting the reaction product with an unsaturated carboxylic acid to form the oil-soluble phosphorus antiwear additive including the ashless dialkyl dithiophosphate.

Suitable organic hydroxy compounds may include normal straight chain alcohols, branched chain alcohols, hydroxy aryl compounds, such as phenol and naphthol, substituted aryl hydroxy compounds, such as diamyl phenol, or any other hydroxy organic material in which the hydroxy group will react with the phosphorus pentasulfide, In one approach, the staring alcohols are saturated alcohols or substituted aryl hydroxy compounds such as aryl hydroxy compounds substituted by saturated alkyl radicals. In some approaches, the organic hydroxy compound may be a $C_1$ to $C_{10}$ (in other approaches, a $C_1$ to $C_6$) linear or branched alcohols, a hydroxy aryl compound, or mixtures thereof such as one or more of methyl alcohol, ethyl alcohol, propyl alcohol, isopropyl alcohol, butyl alcohol, isobutyl alcohol, tert-butyl alcohol, sec-butyl alcohol, phenol, naphthol, an amyl alcohol, hexyl alcohol, iso-hexyl alcohol, octyl alcohol, decyl alcohol, dodecyl alcohol, octadecyl alcohol, 2-ethylhexyl alcohol, 4-methyl-2-pentyl alcohol, phenyl alcohol, butylphenyl alcohol, cyclohexyl alcohol, methylcyclopentyl alcohol, propenyl alcohol, butenyl alcohol, or combinations thereof. Preferred organic hydroxy compounds herein include $C_1$ to $C_4$ alcohols such as ethyl alcohol, propyl alcohol, or isopropyl alcohol, and most preferably, the organic hydroxy compound is isobutyl alcohol.

Suitable unsaturated carboxylic acids to form the oil-soluble phosphorus antiwear additives of the present disclosure may include a wide variety of unsaturated carboxylic acids or fatty acids. Preferred unsaturated carboxylic acids may include $C_1$ to $C_{20}$ unsaturated fatty acids such as acrylic acid, methacrylic acid, 2-ethyl acrylic acid, or combinations thereof and, most preferably, is methacrylic acid. (As used herein, (meth)acrylic acid refers to either acrylic acid or methacrylic acid.)

In some embodiments, the second phosphorus-providing additive is an acidic thiophosphate or a thiophosphate ester present in an additive concentrate in an amount to provide between 800 ppm and 1300 ppm phosphorus and less than 2800 ppm sulfur to the additive concentrate. In another embodiment, the second phosphorus-providing additive is an acidic thiophosphate or a thiophosphate ester present in an additive concentrate in an amount to provide between 900 ppm and 1200 ppm phosphorus and less than 2500 ppm sulfur to the additive concentrate. In one approach, the additive concentrate includes about 0.80 weight percent to about 1.75 weight percent of an ashless dialkyl dithiophosphate compound, in other approaches, about 0.9 weight percent to about 1.40 weight percent, about 1.0 weight percent to about 1.3 weight percent.

In approaches or embodiments, the electric motor lubricating fluids herein may also include a second phosphorus-providing additive in the form of an ashless dialkyl dithiophosphate compound in an amount to provide about 40 to about 70 ppm phosphorus and less than 160 ppm sulfur to the fluid. In some embodiments, the electric motor lubricating fluids herein may include a second phosphorus-providing additive in the form of an ashless dialkyl dithiophosphate compound in an amount to provide about 50 to about 65 ppm of the total phosphorus and less than 140 ppm sulfur. In one approach or embodiment, the electric motor lubricating fluids herein include about 0.03 weight percent to about 0.1 weight percent of an ashless dialkyl dithiophosphate compound, in other approaches, about 0.04 weight percent to about 0.08 weight percent.

Sulfur-Providing Additive:

The electric motor lubricating fluid includes a sulfur-providing additive. In approaches or embodiments herein, the sulfur-providing additive may be one or more thiadiazole compounds or hydrocarbyl-substituted derivatives thereof in amounts to provide sulfur, but no more than about 950 ppm of sulfur to the lubricating fluids herein. In other approaches, the sulfur-providing compound may be a mixture of thiadiazole compounds or hydrocarbyl-substituted derivatives thereof. Examples of the thiadiazole compound that may be used include, but are not limited to, 2,5-dimercapto-1,3,4-thiadiazole, 2-mercapto-5-hydrocarbylthio-1,3,4-thiadiazole, 2-mercapto-5-hydrocarbyldithio-1,3,4-thiadiazole, 2,5-bis(hydrocarbylthio)-1,3,4-thiadiazole, or 2,5-bis (hydrocarbyldithio)-1,3,4-thiadiazoles. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

In approaches, the thiadiazole or derivative thereof includes one or more compounds having a structure of Formula III:

(Formula III)

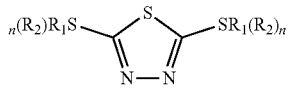

wherein each $R_1$ of Formula III is independently hydrogen or sulfur, each $R_2$ of Formula III is independently an alkyl group, n is an integer of 0 or 1 and if $R_1$ is hydrogen then the integer n of the adjacent $R_2$ moiety is 0 and if $R_1$ is sulfur then the n of the adjacent $R_2$ moiety is 1, and with the proviso that at least one $R_1$ is sulfur. In other approaches, the thiadiazole additive is a blend of compounds of Formula IIIa and Formula IIIb shown below:

(Formula IIIa)

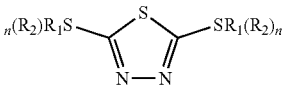

wherein within Formula IIIa each integer n is 1, each $R_1$ is sulfur, and each $R_2$ is a $C_5$ to $C_{15}$ alkyl group, preferably a $C_8$ to $C_{12}$ alkyl group; and (Formula IIIb)

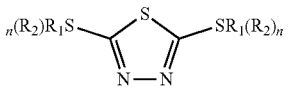

wherein within Formula IIIb one integer n is 1 with an associated $R_2$ group being a $C_5$ to $C_{15}$ alkyl group (preferably a $C_8$ to $C_{12}$ alkyl group) and the other integer n is 0 and with both $R_1$ groups being sulfur. In some embodiments, the sulfur-providing additive includes a blend of Formula IIIa and IIIb with Formula Iva being a majority of the blend and in other approaches, the blend of IIIa and IIIb is about 75 to about 90 weight percent of IIIa and about 10 to about 25 weight percent of IIIb (or other ranges therewithin). In another approach, the sulfur-providing additive is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%).

The thiadiazole compound or hydrocarbyl-substituted derivatives thereof are present in the electric motor lubricating fluids herein in an amount to deliver about no more than about 950 ppm sulfur, no more than about 925 ppm of sulfur, or no more than about 900 ppm of sulfur and, in other embodiments, at least about 700 ppm of sulfur, or at least about 800 ppm of sulfur (or other ranges therewithin). In one embodiment, the thiadiazole compound is 2,5-dimercapto-1,3,4-thiadiazole and this thiadiazole compound or hydrocarbyl-substituted derivatives thereof are present in the lubricating and cooling fluid an amount to deliver about 700 to about 950 ppm sulfur, or about 750 to about 900 ppm sulfur (or other ranges therewithin).

Base Oil:

The electric motor lubricating fluids herein include one or more base oils having a lubricating viscosity. Base oils suitable for use in formulating the electric motor lubricating fluids for use in electric and/or hybrid-electric motor vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

The base oil as used in the invention described herein may be a single base oil or may be a mixture of two or more base oils. The one or more base oil(s) may be selected from any of the base oils in Groups III or IV as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| API Group I | >0.03 | and/or | <90 | 80 to 120 |
| API Group II | ≤0.03 | and | ≥90 | 80 to 120 |
| API Group III | ≤0.03 | and | ≥90 | ≥120 |
| API Group IV | All polyalphaolefins (PAOs) | | | |
| API Group V | All others not included in Groups I, II, III, or IV | | | |

In one variation, the base oil may be selected from an API Group III base oil, or an API Group IV base oil, or a mixture of these base oils. Alternatively, the base oil may be a mixture of two or more of an API Group III base oils, or two or more of an API Group IV base oils.

API Group III base oils may include oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

The base oil(s) are combined with an additive composition as disclosed in embodiments herein to provide a lubricating and cooling fluid for use in an electric motor system having an electric motor, gears, and clutches. Accordingly, the base oil may be present in the lubricating and cooling fluid in an amount greater than about 80 wt % based on the total weight of the lubricating and cooling fluid. In some embodiments, the base oil may be present in the lubricating and cooling fluid in an amount greater than about 85 wt % based on the total weight of the lubricating and cooling fluid.

Other Additives

The electric motor lubricating fluid described herein may also include other additives of the type used in transmission fluid compositions in addition to the components described above. Such additives include, but are not limited to, antioxidant(s), viscosity modifier(s), phosphorus-containing components, detergent(s), corrosion inhibitor(s), antirust additives, antifoam agent(s), demulsifier(s), pour point depressant(s), seal swell agent(s), and additional dispersant(s), additional friction modifier(s), and additional sulfur-containing component(s).

ANTIOXIDANTS: In some embodiments, the electric motor lubricating fluid contains one or more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

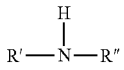

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e., those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating and cooling fluid described herein may be present in an amount to deliver up to about 200 ppm nitrogen, or up to about 150 ppm nitrogen, or about 100 to about 150 ppm nitrogen.

FRICTION MODIFIERS: In some embodiments, the electric motor lubricating fluid contains additional friction modifiers other than those contained in the friction modifier system described above. Suitable additional friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

If the additional friction modifiers contain nitrogen, such additional friction modifiers may be present in the lubricating and cooling fluid in any amount as long as the performance requirements are not compromised.

DETERGENTS: Metal detergents that may be included in the electric motor lubricating fluid described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the lubricating and cooling fluid in an amount sufficient to improve the anti-rust performance of the fluid. The metal-containing detergent may be present in the fluid in an amount sufficient to provide up to 90 ppm alkali and/or alkaline earth metal based on a total weight of the lubricating and cooling fluid. In one example, the metal-containing detergent may be present in an amount sufficient to provide from about 20 to about 50 ppm alkali and/or alkaline earth metal. In another embodiment, the metal-containing detergent may be present in an amount sufficient to provide from about 30 to about 40 ppm alkali and/or alkaline earth metal.

In one approach, preferred detergents may be neutral to low base sulfonates, and in some approaches, calcium sulfonates. Suitable detergents may be calcium sulfonates having a TBN of 50 or less (such as about 25 to about 30) and providing no more than about 50 ppm of calcium to the lubricant. In other approaches, the detergents may provide about 25 to about 40 ppm of calcium, about 30 to about 40 ppm of calcium, or about 30 to about 38 ppm of calcium to the finished electric motor lubricating fluid or composition. In terms of an additive concentrate, the detergent may provide to more than about 950 ppm of calcium to an additive concentrate, or about 500 to about 950 ppm of calcium, about 550 to about 900 ppm of calcium, about 600 to about 800 ppm of calcium, or about 600 to about 700 ppm of calcium to an additive concentrate.

CORROSION INHIBITORS: Rust or corrosion inhibitors may also be included in the electric motor lubricating fluid described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines, acid phosphates, amines, polyethoxylated compounds such as ethoxylated amines, ethoxylated phenols, and ethoxylated alcohols, imidazolines, aminosuccinic acids or derivatives thereof, and the like. Mixtures of such rust or corrosion inhibitors may be used. The total amount of corrosion inhibitor, when present in the lubricating composition described herein may range up to 2.0 wt % or from 0.01 to 1.0 wt % based on the total weight of the lubricating composition.

VISCOSITY MODIFIERS: The electric motor lubricating fluid may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The electric motor lubricating fluid described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to about 1.0 wt %, or up to about 0.5 wt %, or up to about 0.3 wt % based on the total weight of the lubricating and cooling fluid.

DEMULSIFIERS: Demulsifiers include trialkyl phosphates, and various polymers and copolymers of ethylene glycol, ethylene oxide, propylene oxide, or mixtures thereof, including polyethylene oxides, polypropylene oxides and (ethylene oxide-propylene oxide) polymers. When present, the amount of demulsifier in the lubricating and cooling fluid may be up about 0.05 wt, or up to about 0.02 wt %, or below about 0.015 wt % based on the total weight of the lubricating and cooling fluid.

ANTIFOAM AGENTS: Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating and cooling fluid may be up about 0.1 wt, or up to about 0.05 wt %, or below about 0.04 wt % based on the total weight of the lubricating and cooling fluid.

POUR POINT DEPRESSANTS: The electric motor lubricating fluid may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from about 0.001 wt % to about 0.04 wt %, based upon the total weight of the lubricant.

In general terms, a lubricating and cooling fluid described herein may include additive components in the ranges listed in Table 2.

TABLE 2

| Component | Wt % (Suitable Embodiments) | Wt % (Preferred Embodiments) |
|---|---|---|
| Relatively High Molecular Weight Succinimide Dispersant | 1.0-8.0 | 2.0-4.0 |
| Optional other dispersants | 0-5.0 | 0-2.0 |
| Sulfurized component | 0.05-1.5 | 0.2-1.0 |
| Amine salt of a phosphoric acid ester | 0.3-0.7 | 0.4-0.6 |
| Oil-soluble phosphorus antiwear additives | 0.05-1.5 | 0.05-0.5 |
| Detergent(s) | 0.05-0.5 | 0.1-0.3 |
| Antioxidant(s) | 0.1-0.6 | 0.3-0.5 |
| Antifoaming agent(s) | 0-0.05 | 0.1-0.04 |
| Viscosity index improver(s) | 0-7.0 | 0-5.0 |
| Base oil(s) | Balance | Balance |
| Total | 100 | 100 |

The percentages of each component above represent the weight percent of each component, based upon the total weight of the lubricating and cooling fluid containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

As noted above, the additive concentrates including the relatively high molecular weight succinimide dispersants, the amine salt of a phosphoric acid ester, the ashless dialkyl dithiophosphate, and the thiadiazole or derivative thereof had a much higher viscosity that commonly used in vehicle lubricants having viscosities at kV100° C. of about 4.5 cSt or less, about 3.5 cSt or less, or about 3.0 cSt or less. In some approaches, additive concentrates herein of such components have a kV100° C. of about 15 to about 80 cSt, but when used in finished fluids with the noted elemental relationships, the electric motor lubricating fluids herein still have a finished kV100° C. of about 4.5 cSt or less, about 3.5 cSt or less, or about 3.0 cSt or less with improved wear, conductivity, and oxidative stability. In some embodiments, a ratio of the kV100° C. of the additive concentrate to the kV100° C. of the finished fluid is about 5:1 to about 30:1. Any embodiment of the electric motor lubricating fluids herein exhibit only a slight change in viscosity after aging, such as a change of about 0.10 cSt or less (e.g., 0.01 to 0.1 cSt or 0.04 to 0.08 cSt) after the fluid has been aged according to CEC L-48-A at 170° C. to 180° C. for at least 192 hours. The electric motor lubricating fluids herein also achieve a failure load stage of at least 8 in the FZG A10/16.6R/90 scuffing test of CEC L-84-02. Lastly, the electric motor lubricating fluids herein also have an electrical conductivity of about 60 nS/M or less (e.g., about 20 to about 60 nS/M) as measured by a modified conductivity test pursuant to ASTM D2624-15 using the electric motor lubricating fluid and measured at 20 Hz and at about 100° C. using a Flucon epsilon tester or equivalent. It was surprising that such low viscosity fluids, having low conductivity and high oxidative stability, could achieve the above acceptable performance in the FZG A10/16.6R/90 scuffing test of CEC L-84-02.

EXAMPLE

A better understanding of the present disclosure and its many advantages may be clarified with the following example. The following example is illustrative and not limiting thereof in either scope or spirit. Those skilled in the art will readily understand that variations of the components, methods, steps, and devices described in these examples can be used. Unless noted otherwise or apparent from the context of discussion in the Example below and throughout this disclosure, all percentages, ratios, and parts noted in this disclosure are by weight.

To demonstrate how a high-molecular weight dispersants can be used in a low viscosity fluid to achieve passing wear and conductivity, the systems herein compared fluids with various elemental relationships of nitrogen, boron, sulfur, and/or phosphorus to evaluate the wear, oxidation stability, and conductivity of the fluids in extreme low viscosity fluids having a kV100° C. of about 4.5 cSt or less, about 3.5 cSt or less, about 3.0 cSt or less, or about about 2.9 cSt or less. The formulations were evaluated for FZG scuffing, oxidative viscosity stability, and electrical conductivity.

FZG Scuffing was used to evaluate the scuffing load capacity of lubricants and was performed according to the A10/16.6R/90 test of CEC L-84-02. Results are reported in failure load stage, and better results are obtained for samples with a higher failure load stage.

Oxidative viscosity stability was used to evaluate the difference between initial and final viscosity after aging the fluid according to CEC L-48-A-00 with operating conditions of 170° C. to 180° C. for 192 hours with the aging conducted on the fluids for this Example at 170° C. Lower values suggest improved performance. Thus, fluids having high oxidative stability exhibit only a small change in viscosity measured before and after aging.

It is beneficial for electric motor fluids to exhibit low conductivity. The conductivity of fluids was measured according to a modified version of ASTM D2624-15 (testing of a lubricant, rather than of a fuel) using a Flucon Epsilon+ at 1.5 V, 20 Hz, and at 100° C.

The Inventive and Comparative formulations tested in Table 3 below all contained varying amounts of sulfurized components, phosphorus additives, detergent, and dispersants as set forth in Table 3. Each fluid further contained the same antioxidant, antifoam and process oil. The antioxidant and antifoam were added to each fluid at identical treat rates. The inventive and comparative formulations were tested in the same base oils to obtain finished fluids having kinematic viscosities at 100° C. as shown in the Table below. The inventive formulations contain similar additives to the comparative formulations but balanced the delivery of sulfur, phosphorus, and dispersants differently to achieve surprisingly improved wear, oxidation stability, and lubricant conductivity. Details of these components are described below:

Sulfur Component (S-1): 2,5-dimercapto-1,3,4-thiadiazole and/or derivatives thereof containing approximately 35 wt % sulfur, which was a 75:25 to 85:15 mixture of 2,5-bis-(nonyldithio)-1,3,4-thiadiazole and 2,5-mono-(nonyldithio)-1,3,4-thiadiazole.

Dispersant 1 (Disp-1): phosphorylated and borated succinimide dispersant made from a 950 Mn polyisobutylene, maleic anhydride, a mixture of polyalkylene polyamines having an average of 6.5 nitrogen atoms per molecule, phosphorous acid, and boric acid. This dispersant had approximately 0.76 wt % phosphorus, approximately 0.35 wt % boron, and approximately 1.75% nitrogen.

Dispersant 2 (Disp-2): phosphorylated and borated succinimide dispersant obtained from a 2100 Mn polyisobutylene, maleic anhydride, a mixture of polyalkylene polyamines having an average of 6.5 nitrogen atoms per molecule, phosphorous acid, and boric acid. The dispersant had approximately 0.77 wt % nitrogen, about 0.15 wt % boron, and about 0.35 wt % phosphorus.

Phosphorus Additive 1 (P-1): an amine salt of a phosphoric acid ester including a mixture of dihexyl and monohexyl phosphate with di and/or trialkylated amines having alkyl groups of $C_{12}$ to $C_{14}$. This phosphorus source included about 2.5 weight percent nitrogen and about 4.9 weight percent phosphorus.

Phosphorus Additive 2 (P-2): an ashless dialkyl dithiophosphate including at least 3-[[bis(2-methylpropoxy) phosphinothioyl]thio]-2-methyl-propanoic acid.

Detergent Additive 1 (Det-1): neutral calcium sulfonate having a TBN of about 25 to about 30 and about 2.6 weight percent calcium.

All fluids tested herein included the same blend of Group III and Group IV base oils. As shown in the Tables below, all inventive examples exhibited improved wear performance, conductivity performance, and oxidative stability compared to the comparative examples that delivered too little or too much phosphorus and included the relatively lower molecular weight dispersant additives. All fluids were considered low viscosity fluids having a kV100° C. (ASTM D445) of about 4.5 cSt or less.

TABLE 3

Fluid Compositions

| | Inv 1 | Inv 2 | Comp 1 | Comp 2 | Comp 3 | Comp 4 | Comp 5 |
|---|---|---|---|---|---|---|---|
| S-1 (wt %) | 0.25 | 0.25 | 0.25 | 0.25 | 0.25 | 0.25 | 0.25 |
| P-1 (wt %) | 0.12 | 0.12 | 0.12 | 0.12 | 0.06 | 0.24 | .09 |
| P-2 (wt %) | 0.06 | 0.06 | 0.06 | 0.06 | 0.06 | 0.06 | 0.06 |
| Disp-1 (wt %) | — | — | 2.0 | | 1.0 | 1.0 | 1.0 |
| Disp-2 (wt %) | 2.2 | 3.2 | — | 1.0 | — | — | — |
| Det-1 (ppm of calcium) | 34 | 34 | 34 | 34 | 34 | 34 | 52 |
| kV100° C., cSt (additive concentrate) | 25.6 | 71.2 | 11.6 | 6.8 | 5.0 | 5.4 | 5.2 |
| kV100° C., cSt (finished lubricant) | 2.8 | 2.9 | 2.7 | 2.7 | 2.6 | 2.6 | 2.6 |
| kV100° C. viscosity ratio (viscosity of additive concentrate to viscosity of finished fluid) | 9.1:1 | 24.6:1 | 4.3:1 | 2.6:1 | 2.0:1 | 2.1:1 | 2.0:1 |

—kV100° C. was measured pursuant to ASTM D445

TABLE 4

Elemental Analysis of Fluids (calculated)

| | Inv 1 | Inv 2 | Comp 1 | Comp 2 | Comp 3 | Comp 4 | Comp 5 |
|---|---|---|---|---|---|---|---|
| Total phosphorus, ppm | 180 | 238 | 271 | 147 | 160 | 247 | 172 |
| Phosphorus from dispersant, ppm | 76 | 112 | 152 | 35 | 76 | 76 | 76 |
| Phosphorus from P-1, ppm | 59 | 59 | 59 | 59 | 30 | 118 | 44 |
| Phosphorus from P-2, ppm | 54 | 54 | 54 | 54 | 54 | 54 | 54 |
| Nitrogen from dispersant, ppm | 167 | 249 | 350 | 77 | 175 | 175 | 175 |
| Boron from dispersant, ppm | 32 | 47 | 70 | 15 | 35 | 35 | 35 |
| Sulfur, ppm | 875 | 875 | 875 | 875 | 875 | 875 | 875 |

TABLE 5

| Fluid Performance | | | | | | | |
|---|---|---|---|---|---|---|---|
| | Inv 1 | Inv 2 | Comp 1 | Comp 2 | Comp 3 | Comp 4 | Comp 5 |
| FZG, Failure Load stage** | 8 | 9 | 5 | 7 | 5 | 6 | 8 |
| Delta Viscosity, cSt *** | 0.04 | 0.08 | 0.05 | 0.06 | 0.17 | 0.13 | 0.16 |
| Electrical Conductivity, nS/m **** | 22 | 58 | 71 | 13 | 36 | 38 | 37 |

**CEC L-84-022 (A10/16.6R/90)

*** Difference between initial viscosity and final viscosity after aging pursuant to CEC L-48-A

**** ASTM D2624-15 (20 Hz, 100° C.) performed on a Flucon epsilon or equivalent tester It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. An electric motor lubricating fluid suitable for electric or hybrid-electric vehicles, the electric motor lubricating fluid comprising:

one or more base oils of lubricating viscosity;

a succinimide dispersant derived from a polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant delivers about 70 to about 140 ppm phosphorus and about 150 to about 300 ppm nitrogen to the electric motor lubricating fluid;

an amine salt of a phosphoric acid ester providing about 40 to about 70 ppm of phosphorus to the electric motor lubricating fluid;

an oil-soluble phosphorus antiwear additive including an ashless dialkyl dithiophosphate providing about 40 to about 70 ppm of phosphorus to the electric motor lubricating fluid;

a sulfur-providing additive including a thiadiazole or derivative thereof providing up to 950 ppm of sulfur to the electric motor lubricating fluid; and wherein the electric motor lubricating fluid has a kV100° C. of about 4.5 cSt or less and, about 150 to about 250 ppm of total phosphorus.

2. The electric motor lubricating fluid of claim 1, wherein the amine salt of a phosphoric acid ester has the structure of Formula I or a solvate or hydrate thereof:

(Formula I)

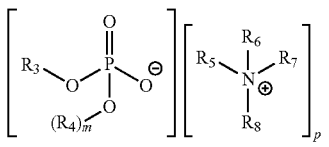

wherein $R_1$ and $R_2$ are, independently, hydrogen or a linear, branched, or cyclic hydrocarbyl group;

m is an integer from 0 to 1, p is an integer from 1 to 2, and m+p equals 2;

$R_3$, $R_4$, $R_5$, and $R_6$ are, independently, hydrogen or a hydrocarbyl group and at least one of $R_3$ to $R_6$ is a hydrocarbyl group.

3. The electric motor lubricating fluid of claim 2, wherein $R_1$ and $R_2$ are, independently, a $C_3$ to $C_{10}$ alkyl group and wherein at least one of $R_3$, $R_4$, $R_5$ and $R_6$ is a $C_{10}$ to $C_{20}$ alkyl group.

4. The electric motor lubricating fluid of claim 1, wherein the number average molecular weight of the high molecular weight polyisobutylene is about 2,000 to about 2,300.

5. The electric motor lubricating fluid of claim 4, wherein the electric motor lubricating fluid includes about 2 to about 4 weight percent of the succinimide dispersant.

6. The electric motor lubricating fluid of claim 1, wherein the succinimide dispersant, the amine salt of a phosphoric acid ester, the ashless dialkyl dithiophosphate, and the thiadiazole or derivative thereof are provided in an additive concentrate and wherein the additive concentrate has a kV100° C. of about 15 to about 80 cSt.

7. The electric motor lubricating fluid of claim 6, wherein a ratio of the kV100° C. of the additive concentrate to the kV100° C. of the electric motor lubricating fluid is about 5:1 to about 30:1.

8. The electric motor lubricating fluid of claim 1, wherein the electric motor lubricating fluid has a change in viscosity of less than 0.09 cSt after the electric motor lubricating fluid has been aged according to CEC L-48-A).

9. The electric motor lubricating fluid of claim 1, wherein the electric motor lubricating fluid achieves a failure load stage of at least 8 in the FZG A10/16.6R/90 scuffing test of CEC L-84-02.

10. The electric motor lubricating fluid of claim 1, wherein the electric motor lubricating fluid has an electrical conductivity of about 60 nS/M or less as measured by a modified conductivity test pursuant to ASTM D2624-15 using the electric motor lubricating fluid and measured at 20 Hz and at 100° C.

11. The electric motor lubricating fluid of claim 1, wherein the oil-soluble phosphorus antiwear additive including the ashless dialkyl dithiophosphate is made by a process comprising the steps of (a) reacting an organic hydroxy compound with phosphorus pentasulfide to form a reaction product and further reacting the reaction product with an unsaturated carboxylic acid to form the oil-soluble phosphorus antiwear additive including the ashless diaalkyl dithiophosphate.

12. The electric motor lubricating fluid of claim 1, wherein the ashless dialkyl dithiophosphate includes a compound of Formula II, or a salt thereof:

(Formula II)

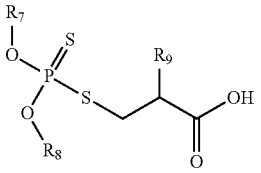

wherein $R_7$ and $R_8$ are, independently, a $C_3$ to $C_8$ linear or branched alkyl group, and $R_9$ is —H or —$CH_3$.

13. The electric motor lubricating fluid of claim 12, wherein the ashless dialkyl dithiophosphoate is 3-[[bis(2-methylpropoxy) phosphinothioyl]thio]-2-methyl-propanoic acid.

14. The electric motor lubricating fluid of claim 1, wherein the thiadiazole or derivative thereof includes one or more compounds having a structure of Formula III:

(formula III)

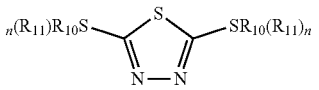

wherein each $R_{10}$ is, independently, hydrogen or sulfur;

each $R_{11}$ is, independently, an alkyl group;

n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur.

15. The electric motor lubricating fluid of claim 1, further including one or more metal-containing detergent additives providing no more than about 50 ppm of calcium to the electric motor lubricating fluid.

16. An additive concentrate suitable for an electric motor lubricating fluid, the additive concentrate comprising:

a succinimide dispersant derived from a high molecular weight polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant is present in an amount to deliver about 1400 to about 2450 ppm phosphorus and about 3000 to about 5400 ppm nitrogen to the dispersant additive concentrate;

an amine salt of a phosphoric acid ester providing about 1000 to about 1500 ppm of phosphorus to the additive concentrate;

an oil-soluble phosphorus antiwear additive including an ashless dialkyl dithiophosphate providing about 800 ppm to about 1300 ppm of phosphorus to the additive concentrate;

a sulfur-providing additive including a thiadiazole or derivative thereof providing sulfur, but no more than about 18,000 ppm of sulfur to the additive concentrate; and wherein the additive concentrate has a kV100° C. of about 15 cSt to about 80 sCt.

17. The additive concentrate of claim 16, wherein the number average molecular weight of the high molecular weight polyisobutylene is about 2,000 to about 2,300.

18. The additive concentrate of claim 16, wherein the succinimide dispersant comprises about 40 to about 70 weight percent of the additive concentrate.

19. The additive concentrate of claim 16, further including one or more metal-containing detergent additives providing no more than about 950 ppm of calcium to the additive concentrate.

20. A method for lubricating a driveline component including an electric motor, the method comprising:

lubricating the driveline component with an electric motor lubricating composition and wherein the electric motor lubricating composition contacts portions of the electric motor;

the electric motor lubricating composition including (i) one or more base oils of lubricating viscosity; (ii) a succinimide dispersant derived from a high molecular weight polyisobutylene having a number average molecular weight of about 2,000 or greater, wherein the succinimide dispersant has about 0.5 to about 1 weight percent nitrogen and is post treated with a phosphorus containing compound and a boron containing compound, and wherein the succinimide dispersant delivers about 70 to about 140 ppm phosphorus and about 150 to about 300 ppm nitrogen to the electric motor lubricating fluid; (iii) an amine salt of a phosphoric acid ester providing about 40 to about 70 ppm of phosphorus to the electric motor lubricating fluid; (iv) an oil-soluble phosphorus antiwear additive including an ashless dialkyl dithiophosphate providing about 40 to about 70 ppm of phosphorus to the electric motor lubricating fluid; and (v) a sulfur-providing additive including a thiadiazole or derivative thereof providing sulfur, but no more than about 950 ppm of sulfur to the electric motor lubricating fluid; and wherein the electric motor lubricating fluid has a kV100° C. of about 3.5 cSt or less, about 150 to about 200 ppm of total phosphorus, and an electrical conductivity of about 37 nS/M or less, as measured by a modified conductivity test pursuant to ASTM D2624-15 using the electric motor lubricating fluid and measured at 20 Hz and at 100° C.

21. The method for lubricating a driveline component including an electric motor of claim 20, wherein the number average molecular weight of the high molecular weight polyisobutylene is about 2,000 to about 2,300.

22. The method for lubricating a driveline component including an electric motor of claim 20, wherein the electric motor lubricating fluid includes about 2 to about 4 weight percent of the succinimide dispersant.

23. The method for lubricating a driveline component including an electric motor of claim 20, wherein the succinimide dispersant, the amine salt of a phosphoric acid ester; the oil-soluble phosphorus antiwear additive including an ashless dialkyl dithiophosphate; and the sulfur-providing additive including a thiadiazole or derivative thereof are provided in an additive concentrate having a kV100° C. of about 15 to about 80 cSt.

24. The method for lubricating a driveline component including an electric motor of claim 23, wherein a ratio of the kV100° C. of the additive concentrate to the kV100° C. of the electric motor lubricating fluid is about 5:1 to about 30:1.

25. The method for lubricating a driveline component including an electric motor of claim 20, wherein the electric motor lubricating fluid has a change in viscosity of less than 0.09 cSt after the electric motor lubricating fluid has been aged according to CEC L-48-A.

26. The method for lubricating a driveline component including an electric motor of claim 20, wherein the electric motor lubricating fluid achieves a failure load stage of at least 8 in the FZG A10/16.6R/90 scuffing test of CEC L-84-02.

27. The method for lubricating a driveline component including an electric motor of claim 20, wherein the electric motor lubricating composition further includes one or more metal-containing detergent additives providing no more than about 50 ppm of calcium to the electric motor lubricating composition.

* * * * *